US008153939B2

(12) United States Patent
Gaulard et al.

(10) Patent No.: US 8,153,939 B2
(45) Date of Patent: Apr. 10, 2012

(54) FLUID-HEATING DEVICE COMPRISING A THERMAL FUSE

(76) Inventors: Hervé Gaulard, Courtefontaine (FR); Thierry Gourand, Orchamps (FR)

( * ) Notice: Subject to any disclaimer, the term of this patent is extended or adjusted under 35 U.S.C. 154(b) by 725 days.

(21) Appl. No.: 12/088,970

(22) PCT Filed: Sep. 29, 2006 (Under 37 CFR 1.47)

(86) PCT No.: PCT/FR2006/002211

§ 371 (c)(1), (2), (4) Date: Dec. 17, 2008

(87) PCT Pub. No.: WO2007/039681

PCT Pub. Date: Apr. 12, 2007

(65) Prior Publication Data

US 2011/0103780 A1 May 5, 2011

(30) Foreign Application Priority Data

Oct. 5, 2005 (FR) ..... 05 10192

(51) Int. Cl.

| | |
|---|---|
| ***H05B 1/02*** | (2006.01) |
| ***H05B 3/22*** | (2006.01) |
| ***H05B 3/26*** | (2006.01) |
| ***H05B 3/46*** | (2006.01) |
| ***F24H 1/10*** | (2006.01) |

(52) U.S. Cl. ..... 219/517; 392/465; 392/468; 392/479

(58) Field of Classification Search ..... 392/468, 392/314, 320, 478, 498; 373/109, 117; 99/330
See application file for complete search history.

(56) References Cited

U.S. PATENT DOCUMENTS

| | | | | |
|---|---|---|---|---|
| 5,702,623 | A * | 12/1997 | Sharples | 219/436 |
| 5,847,638 | A * | 12/1998 | Sorenson | 337/380 |
| 6,741,159 | B1 | 5/2004 | Kuczynski | 337/403 |
| 7,286,752 | B2 | 10/2007 | Gourand | 392/479 |

FOREIGN PATENT DOCUMENTS

| | | | |
|---|---|---|---|
| FR | 2 778 729 | A1 | 11/1999 |
| FR | 2 855 359 | A1 | 11/2004 |

OTHER PUBLICATIONS

Preliminary Search Report, French application No. 0510192 dated Jun. 20, 2006.
International Search Report, application No. PCT/FR2006/002211 dated Feb. 2, 2007.
Preliminary International Report on Patentability (with English translation), application No. PCT/FR2006/002211 dated Dec. 21, 2007.

* cited by examiner

*Primary Examiner* — Joseph M Pelham
*Assistant Examiner* — Diallo I Duniver
(74) *Attorney, Agent, or Firm* — Seyfarth Shaw LLP

(57) ABSTRACT

The invention relates to a fluid-heating device (1) comprising: a fluid circulation conduit (5), electric heating means (4), and a switch (6) which can be moved selectively between a configuration in which the electric heating means are powered and a configuration in which the electric power being supplied to the electric heating means is cut off. The invention also comprises a thermally-fusible part (7) which is intended to be heated by the electric heating means when in operation and which is designed (i) to fuse at least partially when at least one area (8) of the electric heating means exceeds a critical temperature threshold and (ii) to move the switch (6) from the power supply configuration to the power cut-off configuration.

9 Claims, 2 Drawing Sheets

FLUID-HEATING DEVICE COMPRISING A THERMAL FUSE

CROSS-REFERENCE TO RELATED APPLICATIONS

This application is a 371 filing of International application no. PCT/FR2006/002211 filed Sep. 29, 2006.

FIELD

This invention relates in general to the field of electric fluid-heating devices.

SUMMARY

More particularly, the invention relates to a fluid-heating device comprising a fluid circulation conduit, electric heating means disposed in order to heat the fluid travelling through the fluid conduit, and a switch, which is electrically connected to the electric heating means, this switch being selectively movable between a power-supplying configuration for supplying electric power to said electric heating means and a power cut-off configuration for prohibiting electric power to be supplied to said heating means.

It may occur that such a device will exceed a critical temperature. A phenomenon such as this occurs frequently when the device is heated while empty, i.e., when the fluid conduit is no longer conveying enough fluid or any fluid at all.

This phenomenon occurs, for example, in the event of a failure of a thermostat serving to measure a temperature of the device.

In order to prevent the risks of overheating the device, which can lead to deterioration of the apparatus in which the device is mounted, heating device manufacturers have developed systems which make it possible to disconnect the electric heating means in the event of overheating.

A device of the type defined above, comprising two thermostats mounted in series at the electric ends of the heating means, is known from the document FR 2 778 729. The probability of overheating such an assembly is substantially equal to the product of the malfunctioning probabilities of each of the two thermostats taken individually.

A device of the type defined above is likewise known from the document EP 0 485 211, which comprises a fuse mounted in series in inside the heating means in such a way that, in the event of overheating, the fuse melts and causes the electric power supply to the heating means to be shut off. With a system such as this, there is not always a definite cut-off of the power supply at a single critical temperature.

In this context, the purpose of the invention is to propose a solution aiming to cut off the electric power supply to the electric heating means, beyond a critical threshold, in the event that the fluid-heating device is overheated.

To that end, the device of the invention, which is otherwise consistent with the generic definition thereof provided in the above preamble, is substantially characterised in that a thermally fusible part is disposed in proximity to said electric heating means in order to be heated thereby during operation, said fusible part being designed to melt at least partially when at least one area of said electric heating means exceeds a critical temperature threshold, and in order to then cause the switch to shift from the power-supplying configuration thereof to the power cut-off position thereof.

The combination of a switch capable of moving between two configurations and a fuse, the function of which is to trigger the shifting of the switch into a power cut-off configuration in the event of overheating, makes it possible:

- on the one hand, to have a definite cut-off of electric power, due to the design of the switch, which is dedicated to this function; and
- on the other hand, to benefit from a reliable detection that a critical temperature threshold has been passed, due to the design of the fusible part, which is dedicated to this function.

Owing to the invention, the functions of detecting that a critical temperature threshold has been passed and that the power supply has been effectively cut-off are disassociated from one another, thereby enabling an element design dedicated to one function.

For example, it is possible to arrange for the switch to have an elastic portion, which naturally forces it to shift into a power cut-off position, the thermally fusible part exerting force for holding the switch in the power-supplying configuration thereof, as long as said area of said heating means has not exceeded said critical temperature threshold.

In this embodiment, as soon as the fusible part has at least partially melted, the holding force is then no longer exerted on the switch, which then shifts into the power cut-off configuration on its own. The power supply cut-off is irreversible in this case, as long as the switch has not been manually repositioned in the power-supplying position thereof, and as long as the fusible part has not been replaced by a brand new part.

It is also possible to arrange for the device to include a main body and a complementary element covering a portion of the main body in order to define said conduit between the main body and an internal face of the complementary element, said switch comprising a connection terminal electrically connected to the electric heating means and formed on an external face of the complementary element, which is opposite said internal face.

The fact that a terminal of the switch is formed directly on the complementary element is advantageous because it:

- makes it possible to simplify the connection of the switch with the electric heating means;
- eliminates the need for a connecting cable between the switch terminal and the heating means:
- facilitates the assembly operations for the device by reducing the number of parts required for the manufacture thereof.

The connection terminal is preferably formed at one end of said electric heating means, so this terminal is both an element of the electric heating means and an element of the switch, which is economically advantageous.

It is also possible to arrange for said switch to comprise a metal contactor one end of which is attached to said main body, this contactor:

- selectively assuming a power-supplying position wherein it is in contact against said connection terminal, the switch then being in the power-supplying configuration;
- selectively assuming a power cut-off position wherein it is separated from the connection terminal, the switch then being in the power cut-off configuration, said elastic portion of the switch consisting of a locally elastic portion of the contactor, which naturally forces the latter to shift into the power cut-off position.

In this preferred embodiment of the invention, the switch is obtained simply, by folding/stamping a metal part (such as copper or stainless steel) to create a metal contact, and by attaching it to the main body via one of its ends. During said folding/stamping, it is then easy to form:

a first rigid, lengthwise portion of the contactor having the function of establishing electrical contact with a connection terminal;

a second rigid, lengthwise portion of the contact having the function of being assembled onto the main body, this assembly being obtainable, for example, by inserting this second rigid contactor portion into a complementary groove formed in the complementary body;

a flexible and elastic portion disposed between the first and second rigid portions, enabling these rigid portions to be elastically movable relative to one another.

This flexible portion enables the switch to be naturally monostable in the power cut-off position thereof.

It is likewise possible to arrange for the electric heating means to comprise at least one screen-printed heating resistor on the external face of the complementary element. Owing to this embodiment, the heat produced by the resistor is transmitted directly to the conduit water through the wall formed by the complementary element, thereby minimizing heat losses and reducing the thermal inertia of the device, the water inside the conduit hence being rapidly heatable.

It is likewise possible to arrange for the thermally fusible part to be a ring surrounding at least a portion of said fluid circulation conduit and at least one portion of said electric heating circuit, this fusible part bearing against a supporting area of said conduit and/or said electric heating means, in order to be heated thereon.

A ring-shaped fusible part promotes symmetrical distribution of the stresses from the switch on the fusible part, this part thus having a very good degree of mechanical strength without necessarily using a large amount of material to produce it.

The ring shape also makes it possible to symmetrise the heat exchanges between the fusible part and the heating means.

It is likewise possible to arrange for the thermally fusible part to have a reduced cross-sectional area situated at the location of the supporting area.

This feature enables the creation of a preferential melting area which is easy to dimension and locate due to the shape thereof. During manufacture of the device, provision is made for the preferential melting area to be disposed so as to be substantially subjected to internal tractive stresses generated by the switch(es). Thus, when this fusible area melts, it breaks solely under the tractive stresses of the switches, thereby enabling a clean and rapid break. When the ring breaks, there is therefore less risk that it will prevent or block the movement (s) of the switches towards the power cut-off configurations thereof.

The probability of the device functioning properly is thus increased relative to what it would be if the breakage area were situated in a bending area of the ring and relative to what it would be if no preferential breakage area had been manufactured.

The fusible part is made of a plastic material because the melting temperature of such a part can be anticipated and adjusted easily via composite chemistry. Furthermore, this ring is made of a material chosen to be electrically non-conductive, thereby avoiding the need to insulate the contactors from the ring.

It is likewise possible to arrange for said contactor to comprise a cut-out section into which a portion of the fusible part is placed, thereby making it possible to mechanically assemble said fusible part and the contactor, at least as long as the contactor is in the power-supplying position.

This embodiment makes it possible to have a mechanically stable switch/fusible part assembly as long as this fusible part is not melted.

It is likewise possible to arrange for the device to comprise two switches that are substantially identical to one another and electrically connected to said electric heating means in order to enable power to be selectively supplied thereto and for said thermally fusible part to be disposed so as to interact mechanically with each of the switches simultaneously, this fusible part being further designed:

to hold these switches in the power-supplying configurations thereof, as long as said area of said electric heating means does not exceed the critical threshold temperature and;

to cause these switches to shift from the power-supplying configurations thereof to the power cut-off configurations thereof, when said area of said electric heating means exceeds the critical threshold temperature.

The two switches which are held in the power-supplying configurations thereof, by a single fusible part, shift simultaneously into the power cut-off configuration, thereby multiplying the electric power supply cut-off areas on the same circuit and reducing the amount of circuit-breaking energy having to be absorbed individually by each circuit interrupter.

BRIEF DESCRIPTION OF THE DRAWINGS

Other characteristics and advantages of the invention will become apparent from the following description thereof, which is provided for non-limiting, illustrative purposes, with reference to the appended drawings, in which.

DETAILED DESCRIPTION

Figure 1A:
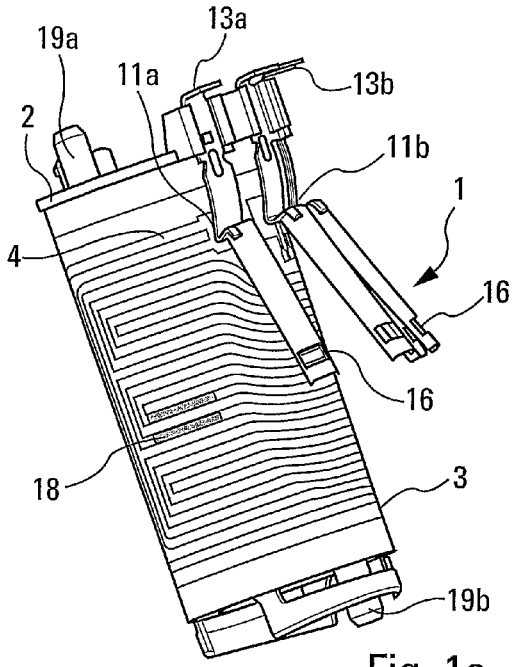
FIG. 1A shows a perspective view of the liquid-heating device of the invention, with the contactors thereof in power cut-off configurations and without the thermally fusible part.
Figure 1B:
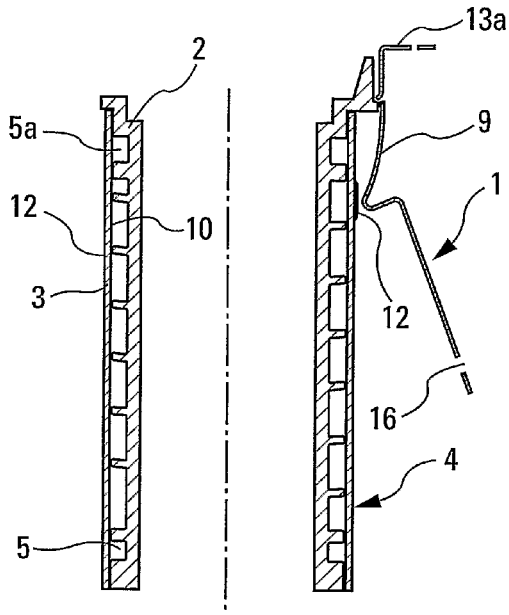
FIG. 1B shows a sectional view of the heating device of the invention showing a contactor in the power cut-off position.

As stated previously, the invention relates to a fluid-heating device comprising a fluid circulation conduit and electric heating means, which in this case are two resistors positioned in parallel and disposed so as to heat the fluid travelling through the fluid conduit. The heating device of the invention is an improvement of the heating device presented in the patent document FR 2 855 359.

This device 1 comprises a cylindrically shaped main body 2 about which is fitted a tube-shaped complementary element 3. A space 5*a* is formed between the main body 2 and the inside face 10 of the complementary element 3 in order to define the fluid conduit 5 between the complementary element 3 and the main body 2.

The fluid conduit 5 is in the form of a coil wound about the main body along the inside face 10 of the complementary element. For this purpose, the main body is made of a material having a low thermal inertia (an inertia lower than that of aluminium) and, at the periphery thereof, comprises a spiral-shaped groove opposite the inside face 10. A fluid inlet 19*a* and outlet 19*b* communicating with the conduit enable the device of the invention to be hooked up to an external fluid system.

The resistors 4 constituting the electric heating means are resistors that have been screen-printed onto the outside face 12 of the complementary element 3, and form two resistive bands running parallel to one another and covering at least 50% of the outside face 12. These resistors 4 run between two supply terminals 11*a*, 11*b* formed on the outside face 12 of the tube-shaped complementary element 3. These supply terminals 11*a*, 11*b* are formed at the ends of the resistors and are substantially identical to one another having a near symmetry of shape along a longitudinal section plane of the complementary element. The supply terminals 11*a* and 11*b* are both electrically accessible from the exterior of the device, in order to enable each movable contactor 13*a*, 13*b* to selectively establish electrical contact with the corresponding connection terminal (terminal 11*a* with contactor 13*a*, and terminal 11*b* with contactor 13*b*).

The contactors are elongated metal parts having three lengthwise portions each performing a particular function.

The first portion of a contactor is a rigid end portion nested inside a groove dedicated to the fitting of this contactor over a peripheral protuberance of the main body 2. For this purpose, the main body is electrically insulating, at least at this location, and, for this purpose, said body may consist entirely of a plastic material.

Each first contactor portion is designed to be fit together with a power receptacle of the connector.

The second contactor portion is a locally elastic portion 9 also referred to as the elastic portion of the switch. The function of this second portion is to force a third contactor portion to move away from the connection terminal 11*a* or 11*b* corresponding to the contactor. This second portion has a flat cross section.

The third contactor portion is a contactor portion which is rigid over the length thereof, in order to enable compressive stress to be transmitted from the contactor onto the corresponding connection terminal 11*a* or 11*b*. This third portion has a substantially U-shaped cross section in order to provide this rigidity thereto. This third portion comprises a notched area 16 designed to bearingly receive a portion of the fusible part 7.

An area of the contactor preferably situated in the flexible second portion is folded into a V, in the lengthwise direction of the contactor, in order to form an electrical contact dedicated to the current flow between the contactor and the connection terminal of the complementary element, this contact area being situated at the tip of the V-shaped fold.

Figure 4:
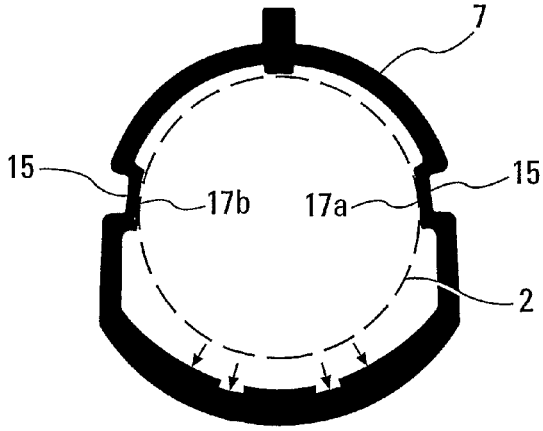
FIG. 4 shows a front view of ring-shaped fusible part.

A thermally fusible part 7 is shown alone in FIG. 4, in the form of a rigid ring having an inner diameter greater than the outer diameter of the complementary element.

Figure 2A:
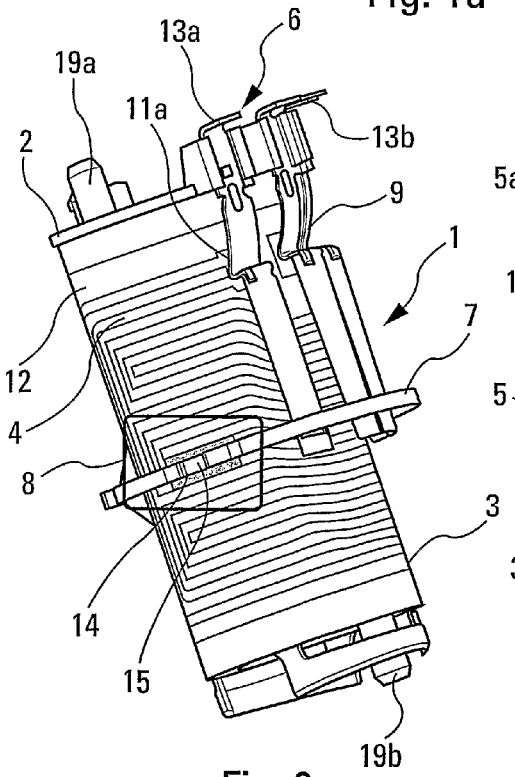
FIG. 2A shows the device of the invention with the switches thereof in power-supplying configurations and with the fusible part not yet melted.
Figure 2B:
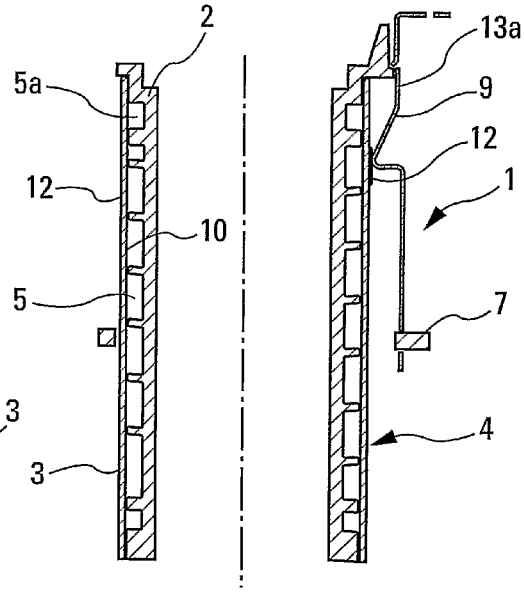
FIG. 2B shows a longitudinal section of the device of FIG. 2A.
Figure 3A:
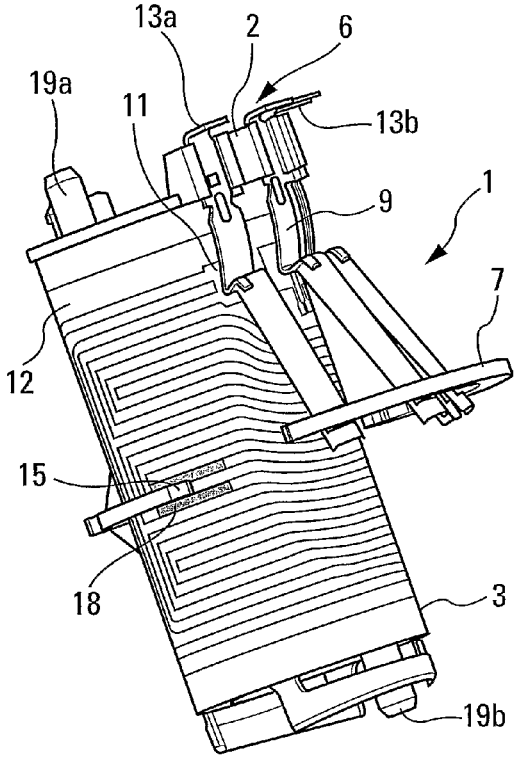
FIG. 3A shows the device of the invention with the switches thereof in power cut-off configurations and with the fusible part broken due to overheating.
Figure 3B:
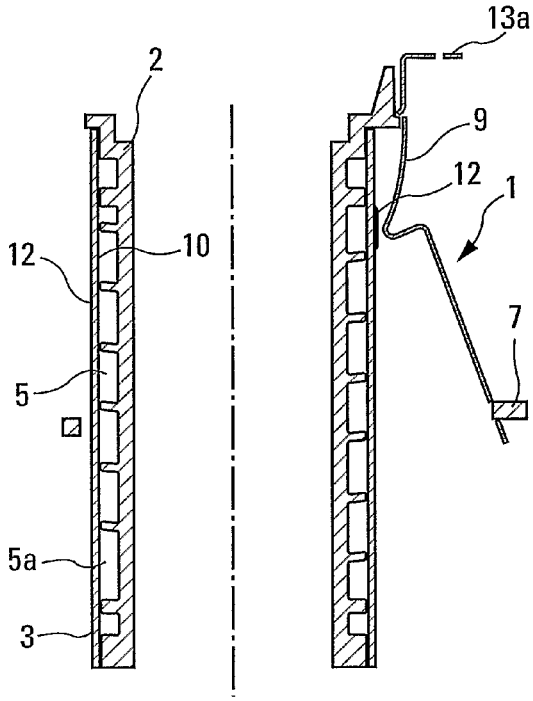
FIG. 3B shows a longitudinal view of the device of FIG. 3A.

This fusible part is also shown in FIGS. 2*a* and 2*b*, but this time in combination with the rest of the device. In these FIGS. 2*a*, 2*b*, the fusible part 7 surrounds the complementary element 3 and holds all of the contactors in the respective power-supplying positions thereof.

As shown in FIG. 4, the fusible part comprises two arc segments 17*a*, 17*b* having a diameter substantially equal to the outer diameter of the complementary element, which is shown by a dashed line referenced as 2. Four arrows represent, respectively, the four stresses exerted on the fusible part by the contactors. These stresses tend to force the arc segments 17*a*, 17*b* against the complementary part. These arc segments 17*a*, 17*b* are opposite one another so as to form a localised bearing area for holding the fusible part on the complementary element. The fusible part comprises a reduced cross-sectional area 15, at the location of the areas 14 where the fusible part bears against the complementary element. This cross-sectional area is provided in order to form the preferential breaking area of the fusible part, when the complementary element is overheated. Thus, during normal operation, this ring enables the contact pressure to be maintained between the contactors and the electrical connection terminals of the resistor. During overheating, the ring melts at the reduced cross-sectional areas 15, thereby releasing the contact pressure and opening the electric power supply circuit for the heating means.

In the embodiment of the invention presented in FIGS. 1*a*, 1*b*, 2*a*, 2*b*, 3*a*, 3*b*, four separate contactors are used to form four substantially identical switches (each switch has a connector attached to the main body and a connection terminal formed on the complementary element 3).

Two of these switches are disposed in order to enable or cut off the power supply to the terminals of the heating means, and two others are used to enable or cut off the power supply to the terminals of a positive temperature coefficient resistor, which is attached to the complementary element 3 in order to measure the temperature thereof.

In one simplified assembly, only two switch blades may be used to control the electrical power supply of the single resistors.

A preferential area 8 is arranged so that the normal operating temperature in this area 8 is compatible with the operating temperature of the fusible element, in order to prevent it from melting prematurely.

In this particular case, in order to limit the temperature of the resistive tracks, the latter are covered by a conductor 18, which facilitates the current flow and prevents overheating of this area 8.

In another assembly, the design of the resistive tracks can be made so as to place the resistive tracks sufficiently distant from or close to the fusible element 7.

In this particular case, the material chosen to produce the fusible element is a plastic material providing a good compromise between temperature resistance and cost. A crystalline material is preferably used, the melting temperature range of which is reduced.

In this particular case, the material of the fusible part, the melting temperature of which is approximately 285° C., is a poly(phenylene sulphide) filled with 32% fibreglass and 32% of a mineral.

The reduced cross-sectional area 15 promoting rapid melting of the material of the fusible element at this precise location preferably measures 2.8 mm×1.4 mm.

These distinctive features, such as the shape of the fusible element in area 15 and the choice of material for the fusible element, depend on the design of the tracks, the need to facilitate the current flow in area 14, the type of resistive tracks, the materials of the complementary element and the design of the main body, and cannot therefore be considered as the only valuable ones in this type of assembly.

The invention claimed is:

1. A Fluid-heating device comprising:

a fluid circulation conduit, electric heating means disposed in order to heat the fluid travelling through the fluid conduit, a switch, which is electrically connected to the electric heating means, said switch being selectively movable between a power-supplying configuration for supplying electric power to said electric heating means and a power cut-off configuration for prohibiting electric power to be supplied to said heating means, and a thermally fusible part disposed in proximity to said electric heating means in order to be heated thereby during operation, said fusible part being designed to melt at least partially when at least one area of said electric heating means exceeds a critical temperature threshold, and in order to then cause the switch to shift from the power-supplying configuration thereof to the power cut-off position thereof, the thermally fusible part being a ring surrounding at least a portion of said fluid circulation conduit and at least one portion of said electric heating circuit, said thermally fusible part comprising an internal diameter greater than an external diameter of the fluid circulation conduit and bearing against a supporting area of said conduit and/or said electric heating means, in order to be heated thereon.

2. The device of claim 1, characterised in that the switch has an elastic portion, which naturally forces it to shift into a power cut-off position, the thermally fusible part exerting force for holding the switch in the power-supplying configuration thereof, as long as said area of said heating means has not exceeded said critical temperature threshold.

3. The device as claimed in claim 1, characterised in that it includes a main body and a complementary element covering a portion of the main body in order to define said conduit between the main body and an internal face of the complementary element, said switch comprising a connection terminal, said connection terminal being electrically connected to the electric heating means and formed on an external face of the complementary element, which is opposite said internal face.

4. The device as claimed in claim 2, characterised in that said switch comprises a metal contactor one end of which is attached to said main body, said contactor:

selectively assuming a power-supplying position wherein said contactor is in contact against said connection terminal, the switch then being in the power-supplying configuration;

selectively assuming a power cut-off position wherein said contactor is separated from the connection terminal, the switch then being in the power cut-off configuration, said elastic portion of the switch consisting of a locally elastic portion of the contactor, which naturally forces the latter to shift into the power cut-off position.

5. The device as claimed in claim 3, characterised in that the electric heating means comprise at least one screen-printed heating resistor on the external face of the complementary element.

6. The device as claimed in claim 1, characterised in that the thermally fusible part has a reduced cross-sectional area situated at the location of the supporting area.

7. The device as claimed in claim 1, characterised in that the fusible part is made of an electrically non-conductive plastic material.

8. The device as claimed in claim 4, characterised in that said contactor comprises a cut-out section into which a portion of the thermally fusible part is placed, thereby making it possible to mechanically assemble said fusible part and the contactor, at least as long as the contactor is in the power-supplying position.

9. The device as claimed in claim 1, characterised in that said switch comprises two switches that are substantially identical to one another and electrically connected to said electric heating means in order to enable power to be selectively supplied thereto and in that said thermally fusible part is disposed so as to interact mechanically with each of said two switches simultaneously, said fusible part being further designed to hold these switches in the power-supplying configurations thereof, as long as said area of said electric heating means does not exceed the critical threshold temperature and to cause these switches to shift from the power-supplying configurations thereof to the power cut-off configurations thereof, when said area of said electric heating means exceeds the critical threshold temperature.

* * * * *